US007865970B2

(12) United States Patent
Giacheri

(10) Patent No.: US 7,865,970 B2
(45) Date of Patent: Jan. 11, 2011

(54) SPORTS LIFTING AID

(76) Inventor: Mark Giacheri, 5 Stanley Street, Queens Park, New South Wales, 2022 (AU)

( * ) Notice: Subject to any disclaimer, the term of this patent is extended or adjusted under 35 U.S.C. 154(b) by 641 days.

(21) Appl. No.: 11/255,399

(22) Filed: Oct. 21, 2005

(65) Prior Publication Data

US 2006/0085884 A1 Apr. 27, 2006

(30) Foreign Application Priority Data

Apr. 22, 2003 (GB) ..... PCT/GB03/01719
Apr. 22, 2004 (GB) ..... PCT/GB2004/001746

(51) Int. Cl.
*A41D 13/00* (2006.01)

(52) U.S. Cl. ..... 2/22

(58) Field of Classification Search ..... 2/16, 2/22, 24, 170, 455, 162, 59, 60, 910; 602/20–23; 128/878–880

See application file for complete search history.

(56) References Cited

U.S. PATENT DOCUMENTS

| | | | | | |
|---|---|---|---|---|---|
| 2,338,424 | A | | 1/1944 | Giardini | 2/22 |
| 4,172,292 | A | * | 10/1979 | Horton | 2/102 |
| 4,554,681 | A | | 11/1985 | Kirkland | 2/2 |
| 4,842,931 | A | | 6/1989 | Zook | 428/354 |
| 5,418,980 | A | * | 5/1995 | Kelly | 2/170 |
| 5,500,955 | A | | 3/1996 | Gongea | 2/24 |
| 5,822,794 | A | * | 10/1998 | Allred | 2/115 |
| 5,829,055 | A | | 11/1998 | Collins et al. | 2/22 |
| 5,983,391 | A | | 11/1999 | Palmer et al. | 2/16 |
| 6,013,342 | A | | 1/2000 | Neto | 428/40.1 |
| 6,105,163 | A | | 8/2000 | Edmiston | 2/22 |
| 6,192,519 | B1 | * | 2/2001 | Coalter | 2/16 |
| 6,226,797 | B1 | | 5/2001 | Tollini | 2/22 |
| 6,588,019 | B1 | * | 7/2003 | Whittle, Jr. | 2/16 |

FOREIGN PATENT DOCUMENTS

| | | |
|---|---|---|
| CA | 2034621 | 7/1992 |
| DE | 200 22 041 | 4/2001 |
| EP | 0 600 584 | 6/1994 |
| EP | 0 916 370 | 5/1999 |
| FR | 2 754 679 | 4/1998 |
| GB | 2 177 892 | 2/1987 |
| GB | 2 347 067 | 8/2000 |
| WO | 99/02052 | 1/1999 |

* cited by examiner

*Primary Examiner*—Tejash Patel
(74) *Attorney, Agent, or Firm*—J. Peter Paredes; Rosenbaum & Silvert, P.C.

(57) ABSTRACT

A grippable sports device in the form of a band is configured for use as a lifting aid and comprises a main body for placing in a position on the limb of a sports player for use during a sports game, the main body comprising fixing means for fixing the main body in a substantially fixed position directly on the player's limb, with the main body further including a non-slip surface configured to enable a second player of the sports game to firmly grip the main body. When the sports band is in a fixed position on a wearer, the fixing means substantially encircles a portion of the wearer's limb. The grippable sports band is particularly useful in a line-out in the game of Rubgy Union.

18 Claims, 5 Drawing Sheets

Points Structure pattern

3Dimensional view

2Dimensional view

Stepped Pyramid pattern

Hexagonal Honeycomb pattern

SPORTS LIFTING AID

CROSS REFERENCE TO RELATED APPLICATIONS

This application is related to prior applications PCT/GB2004/001746 filed Apr. 22, 2004, and PCT/GB03/0001719 filed Apr. 22, 2003, from which priority is claimed under 35 U.S.C. §119.

FIELD OF THE INVENTION

The present invention relates to the field of sports lifting aids and particularly, but not exclusively, relates to grippable sports devices for use as lifting aids in the game of Rugby Union.

BACKGROUND TO THE INVENTION

In certain sports games, and in certain other activities, it is known that a first person may be required to firmly grip a limb of a second person. Thus, for example, in the game of Rugby Union there exists a phase of play known as a lineout. In the lineout phase of the game each team generally has three jumping players that each have access to two supporting players. FIG. 1 schematically illustrates, for the game of Rugby Union, a jumping player 101 supported by a rear supporting player 102 and a front supporting player 103, the purpose of the arrangement of people being to aid player 101 to catch Rugby Union ball 104. The assistance of the supporting players 102, 103 usually takes the form of lifting a given jumping player 101 to reach a greater height or to otherwise hold the jumping player in a raised position. As a general rule one supporting player lifts the jumping player from the rear and another supporting player lifts the jumping player from the front. A synchronization of efforts of the rear and front supporting players enables the body of the jumping player to maintain a balanced position. A rear supporting player may not seize a jumping player lower than the length of the jumping players shorts. The front supporting player may seize the jumping player no lower than the thigh of the jumping player. The regulations imposed on the rear and front supporting players are, for the game of Rugby Union, as outlined by the International Rugby Board (I.R.B.). In particular the I.R.B. has imposed Law 19.9 (k) regarding lineout and this basically states that, as regards support of a player, a player must not support a jumping team-mate below the shorts from behind or below the thighs from the front. With the legs of a player there is generally a lack of grip when attempting to lift a given player in a lineout. The rear supporting player has the jumping player's shorts to grip for the practice of lifting from behind. However, in the known game, there exists no fully satisfactory form of clothing or grip associated with a player to be lifted which is configured for a front supporting player to hold. Thus a problem arises for the front supporting player in that the supporting player must typically directly seize the jumping player's bare thighs. A jumping player's legs may be covered in sweat thereby making it even more difficult for a given supporting player to effectively raise a jumping player as required. Bare skin baring sweat and bare skin baring sweat and rainwater are in turn progressively more difficult situations for a supporting player to deal with. In each case, as regards the jumping player's legs in contact with supporting player's hands, there is a reduced amount of friction between the hands and the legs. As regards the game, slipping of hands about a jumping player's legs creates a hazard to the jumping player and furthermore frequently places the jumping player in a playing position that is less than desirable in order for a given ball to be caught. Furthermore potentially serious problems may arise if the front supporting player's hand slips upwards on a jumping player's leg. In such a case groin injury or discomfort may occur if: a) the front supporting player's hand slips up the thigh and in to the groin area and/or b) the front supporting player lifts the jumping player on the shorts from the front. Although such problems are typically associated with the front supporting player's hand slipping, to some extent such problems may arise in connection with the rear supporting player's hands. In general the most severe problems, hazards, injuries and discomfort to the jumping player and the risk of being unbalanced in the air are generally attributable to support from the "front" supporting player. In particular, such problems arise when the front supporting player's hand slips or if a front supporting player grasps the jumping player's shorts from the front when lifting. Of course grasping the jumping player's shorts from the front can equally cause groin injuries and the like. A more common problem concerns the jumping player being held in an unbalanced manner at a great height in the air. The lack of balance is caused by slipping hands of the support players and may result in a player falling from a great height. Such falling can cause a variety of injuries including head, neck, back and shoulder injuries.

Various methods have been employed to try to alleviate the above problem of lifting a given player in the sport of Rugby Union. A first such method involves a jumping player using one-sided sticky tape bound around the thighs. Such usage of one-sided adhesive tape is an attempt to improve grip, but it has been found that such tape does not actually increase the coefficient of friction to any significant extent. Thus one-sided adhesive tape of the type that is used by some players in the Rugby Union game is known to be relatively ineffective as a form of grip. Furthermore use of one-sided adhesive tape is inconvenient and inefficient and time is wasted in putting the tape on the thighs and removing from the thighs after every use. A lot of one-sided adhesive tape may thus be used and is in fact wasted after the game since it has to be thrown away. This latter problem is made worse by the fact that typically two lengths of tape are required such that the ends of the first strip are sealed to the limb by the second strip being stuck over the end portions of the first applied strip. This makes usage of such tape costly and less than optimal as regards environmental considerations. A further problem with usage of one-sided tape is that it is relatively unappealing to the human eye. Additionally removal of the tape can cause distress to a player since the process of removal is associated with hair removal and repeated application is known to increase the degree of distress and thereby reduce the player's concentration during a game. Tape pinches body hairs of the limbs and is extremely uncomfortable to remove. It is also to be realized that the tape when bound around the leg of a player is restrictive in the sense that it does not readily alter its shape in response to movements of the leg and the muscles within and thereby it can reduce the quality of the performance of the player.

Another known method of improving grip in the game of Rugby Union is to use a sports garment of the type disclosed in GB patent application no. 2347067, in the name of Halbro Sportswear Limited. This reference describes a pair of shorts having integrally formed grips thereon. A problem associated with such shorts is that, since the grips are attached to the shorts, then the leg portions of the shorts are inclined to be raised up (when gripped in a lineout situation) into the crotch area of a given player and thereby may potentially give the player a groin injury or some form of discomfort either during the game being played or more long term. A further reference describing use of grippable members in the game of Rugby Union is French patent publication no. FR 2754679, which describes a similar modified from of shorts to those described in GB 2347067.

Shorts of the kind disclosed in GB 2347067 and FR 2754679 are associated with further problems. Firstly the grippable portions are located on the shorts and are thereby relatively high upon the leg. This limits the height that the supporting players are able to raise the jumping player to. A second problem is that the shorts can easily tear, which again can result in injury and/or serious unbalancing of the jumping player. If the jumping player's shorts are torn then a further disadvantage with shorts of this kind is that the jumping player must then go and purchase another pair of shorts. In other words another pair of shorts comprising grippable members is not a particular durable product. Additionally since the grip structures may be undesirable to the player wearing them during parts of the play where they are not used to aid lifting, then there is a need to provide a grippable sports device that may be readily removed and replaced during play whilst the player is on the playing field.

In view of the above there is a need to provide an improved grippable sports device, and in particular there is a need to provide an improved means for enabling a jumping player to be more effectively and safely raised in a lineout in the game of Rugby Union.

SUMMARY OF THE INVENTION

An object of the present invention is to provide a device for attachment to the human body whereby the device may be effectively gripped by the hands of a second person.

Another object of the present invention is to provide an improved grippable device for placing on a limb of a jumping player in the game of Rugby Union.

A further object of the present invention is to provide a grippable device for use on the human body, the grippable device being intended to reduce injury to a given person being held.

A further object of the present invention is to provide a grippable sports device for use as a lifting aid such that the device does not require use of an adhesive to fix the device to the limb of a person.

A further object of the present invention is to provide a grippable sports device for use as a lifting aid such that the device substantially automatically reverts back to its original shape following use, thereby enabling said device to be re-used.

A further object of the present invention is to provide a grippable sports device for use as a lifting aid such that the device can be readily removed during a sports game without a player having to remove a pair of shorts.

According to a first aspect of the present invention there is provided a sports lifting aid comprising:

a main body for placing in a position on the limb of a sports player for use during a sports game, said main body comprising fixing means that substantially encircles a portion of said limb to thereby fix said main body in a substantially fixed position directly on said limb of said player and said main body further comprising grip means to enable a second player of said sports game to grip said main body and thereby lift said first player, said lifting aid characterized in that said lifting aid is in the form of a sports band, said grip means comprises a non-slip surface specifically configured to enable a said second player of said sports game to grip said main body and at least a portion of said fixing means substantially comprises an elastic or elasticized material for effecting said fixing by virtue of the elastic tension provided by said elastic material.

Preferably when said device is in use said lifting aid is configured to remain in a substantially fixed position on a portion of the thigh of said first player.

Preferably said grip surface of said lifting aid additionally comprises at least one protruding member that is raised above the surrounding grip surface.

Preferably said at least one protruding member comprises a ridge means for further aiding said second player to raise said first player off of the ground, said ridge means configured to abut against at least a first hand of said second player to thereby prevent said hand slipping beyond said ridge.

Preferably said ridge means provides an abutting surface extending at 90° from said non-slip surface.

Preferably said ridge means is formed as an integral part of said main body.

Preferably said ridge is arranged to extend in a direction that is substantially perpendicular to the main longitudinal axis passing through the open ends of said band.

Preferably said at least one protruding member comprises a plurality of different shapes of protruding members.

Preferably said at least one protruding member comprises an array of raised points.

Preferably said at least one protruding member comprises an array of ridges.

Preferably said at least one protruding member comprises an array of raised members interspersed with orifices, said raised members and orifices collectively forming a honeycomb structure.

Preferably said lifting aid does not constitute a part of a pair of shorts.

Preferably said fixing means comprises silicone rubber.

Preferably said fixing means comprises an elastic or elasticized portion and a non-elastic or non-elasticized portion.

Preferably said fixing means does not include use of an adhesive.

Preferably said lifting aid does not comprise an adhesive tape.

Suitably said band comprises a substantially fully walled sleeve.

Alternatively said band suitably comprises a non-fully walled sleeve.

Preferably said fixing means further comprises a second fixing means in the form of a strap.

Preferably said fixing means further comprises a second fixing means in the form of a strap, said second fixing means comprising a loop and pile fixing arrangement.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF A SPECIFIC MODE FOR CARRYING OUT THE INVENTION

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Figure 1:
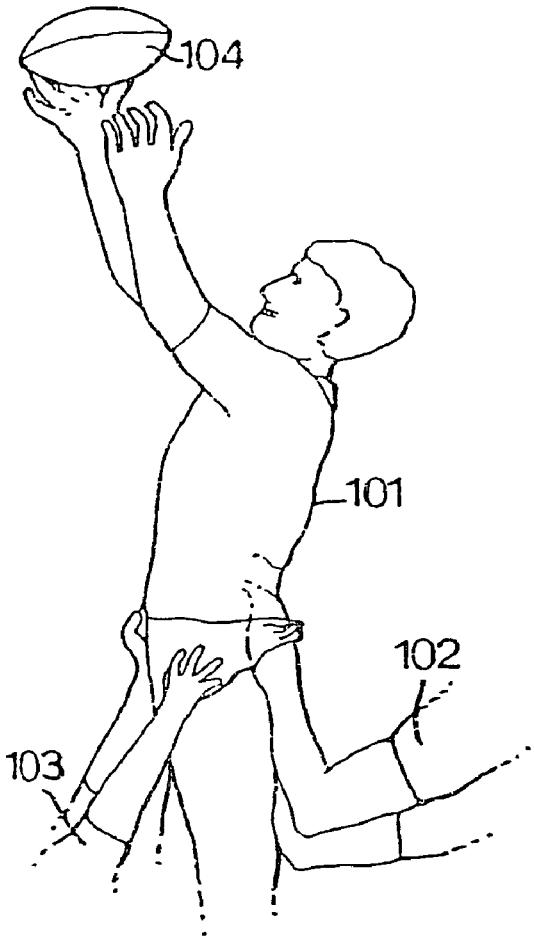
FIG. 1 schematically illustrates, for the game of Rugby Union, the prior art situation of a jumping player supported by a rear supporting player and a front supporting player in order to aid the jumping player to catch a Rugby Union ball.
Figure 2:
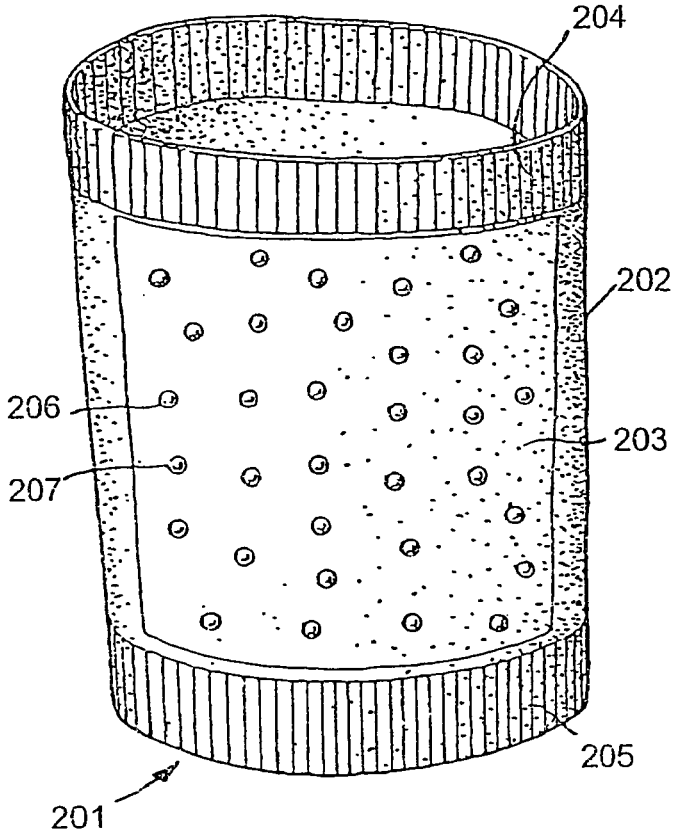
FIG. 2 schematically illustrates a first preferred embodiment of a grippable sports device as configured in accordance with the present invention.

A preferred embodiment of the invention is schematically illustrated in FIG. 2. A grippable sports device 201 is configured for placing in a position on a limb such as a leg of a sports player for use during a sports game. Grippable sports device 201 comprises a main body 202, which in the preferred embodiment comprises a substantially cylindrical member or at least comprises portions configured to substantially encircle a given players leg. The preferred positioning of the device on a player's leg is on the thigh, and in particular on the lower thigh. Main body 202 comprises a grippable portion 203 having a grippable outer surface specifically configured to enable a second player of a given sport game to firmly grip the grippable device. Those skilled in the art will realize that grip means 203 may be configured in numerous ways. In the example shown grip means 203 comprises a silicone rubber material having a number of grip facilitating members 206, 207. Silicone rubber and many other types of rubber provide an improved degree of friction with human hands as compared to hands in contact with human skin. In the example shown members 206, 207 comprise raised portions of the silicone rubber member 203. However a series of grooves and/or short ridges could equally serve to enhance grip on the surface of the member 203. Member 202 is further configured with means for fixing the grippable device in a substantially fixed position directly on a player's leg. Thus elastic or elasticized portions 204 and 205 are provided at the ends of substantially cylindrical based grippable device 201. The elastic or elasticized portions are configured to fit tightly about a given player's leg. The back of the grippable device 201 (not shown) may comprise the same arrangement as that described above or it may comprise only the elastic or elasticized portions at the ends of the device. The main body 202 may comprise a foam based material of the type typically used in support or protective sports guards, such as for example shin guards as used in the game of football. The main requirement of grippable member 203 is that it provides a surface that is designed to act as a non-slip surface. In other words this surface is configured to provide a high degree of friction and therefore should comprise a material or an arrangement that provides a substantially high coefficient of friction between hands placed upon the member and the member itself. The member 203 may be substantially rigid as compared with the remainder of the device and it may be located only towards the front of the device or, in a further preferred embodiment, it may be configured substantially around the entire circumference of the substantially cylindrical shaped device. The main considerations in the design of a grippable sports member, as configured in accordance with the present invention, are that it should be comfortable, flexible and lightweight so that a given player using the device is not unnecessarily distracted from the game in hand.

As those skilled in the art will appreciate the grippable sports device may be configured to fit to a person's body using a variety of methods. Thus rather than using elastic or elasticized portions, straps incorporating a loop and pile arrangement such as the material VELCRO (registered trade mark) or other fastening means could be used.

A further preferred embodiment of the present invention comprises usage of a single material, formed in substantially cylindrical manner (forming a band) and made of a suitable grippable material such as silicone rubber. In this way, such a band may be placed directly upon a leg and thereby provides, by means of tension, the required fixing means to fix the grippable device about a player's leg. In this way such a device inherently provides the required grip means by virtue of the nature of the material used to make the device. Usage of a single material (forming a band) in this way is, as will be readily understood by those skilled in the art, simpler in terms of manufacture of a grippable sports device. The grippable device according to the invention may suitably be made out of a wide variety of materials including, for example, neoprene or polyprene.

Figure 3:
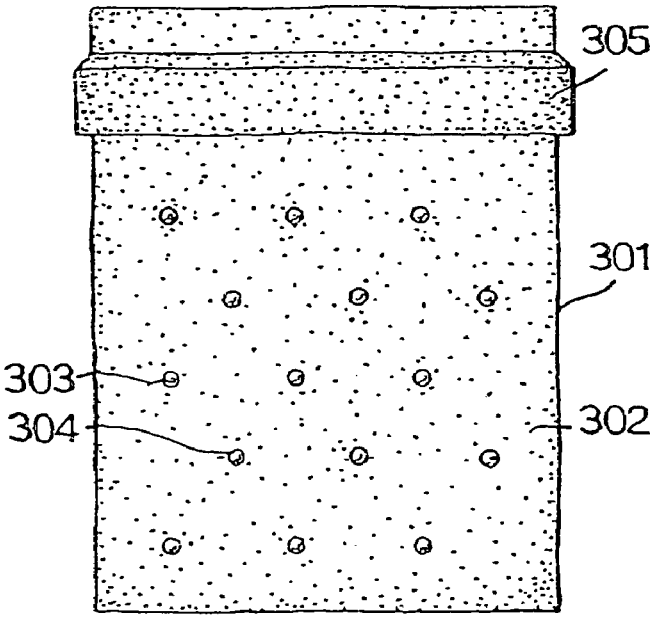
FIG. 3 schematically illustrates a further preferred embodiment of a grippable member of a grippable sports device as configured in accordance with the present invention.

FIG. 3 schematically illustrates a preferred embodiment of a grippable means for incorporation on to the surface of a grippable sports device as configured in accordance with the present invention. Grippable member 301 comprises a material exhibiting a high coefficient of friction when in contact with another player's hands that may be covered in water and/or sweat. The grippable surface may be further grip-enhanced by incorporation of a series of protruding members 303, 304. To further aid grip, as for example for use in a lineout in the game of Rugby Union, a protruding ridge member 305 is also provided towards the top of the grippable member 301. In this way a second player may place his hands upon grippable member 301 with member 305 being configured to prevent a hand of the second player that is in contact with the grippable member moving upwards beyond the protruding ridge 305. This provides an extra safety feature in the game of Rugby Union in that it thereby prevents a hand of a second player slipping beyond the grippable member and potentially causing injury to the player wearing the grippable member 301.

Ridge member 305 comprises a rectangular shaping cross section such that a surface is provided to abut directly against the ends of the fingers of a supporting player's hand. Such a ridge is intended to abut against the hand of a supporting player and therefore an abutting surface extending at 90° from a main player to the grippable member 301 is preferred as this produces the optimum functionality of a "stop". The ridge member may be formed as an integral part of the grippable member or may be a separate member affixed by way of gluing or some form of material welding. The ridge member, in the preferred embodiment, is configured from a substantially rigid material such as for example a plastic based material, a foam based material or a rubber based material. However those skilled in the art will realize that a wide variety of materials may be used for this purpose including rubbers, plastics, polymeric materials etc.

Figure 4:
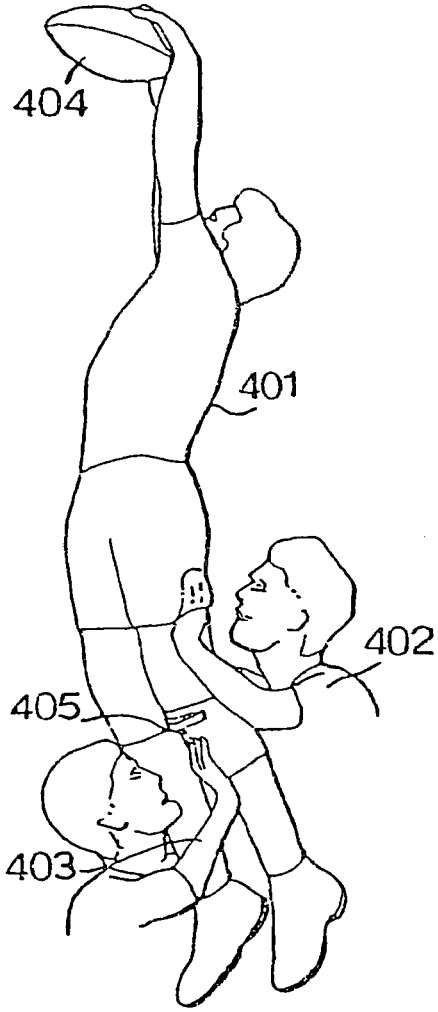
FIG. 4 schematically illustrates usage of a grippable sports device as configured in accordance with the present invention and as used in the game of Rugby Union.

FIG. 4 schematically illustrates use of a grippable sports device, as configured in accordance with the present invention, in the game of Rugby Union. A jumping player 401 is raised up to a suitable position in a Rugby Union lineout by a rear supporting player 402 and a front supporting player 403. Player 401 is required to obtain possession of rugby ball 404 as shown. In accordance with the present invention the grippable sports device 405 is placed on a limb such as the thigh of jumping player 401 so as to, in particular, aid raising of the jumping player 401 by front supporting player 403.

The invention, as those skilled in the art will realize, may be used in a wide range of sports and other activities including, but not limited to rugby, gymnastics; ice skating, cheerleading, the climbing professions, or the sport of rock climbing.

Various aspects from each of the embodiments disclosed may be interchanged. In particular the fixing means for fixing the grippable device in a substantially fixed position directly on a given player's limb may take a variety of forms as previously indicated. Thus, for example, elastic or elasticized portions may be used or strap members using a loop and pile or other type of fastening means. The inner portions of such fixing means may comprise materials to enhance grip to the player's skin. Thus, for example, if elastic or elasticized portions are used then the inner skin facing sides of these portions may comprise silicone rubber to enhance grip to the skin of a given player. In this way the position of the grippable device on a limb of a player is more or less fixed in relation to the limb to which it is attached. However in terms of the present invention "substantially fixed position" may be interpreted to mean fixed directly on to or about a player's skin in contrast to prior art grippable devices of the type that are located on an item of clothing such as a pair of shorts—in prior art shorts comprising grippable devices, the grippable devices are not fixed semi-permanently on to or in close proximity to the player's skin. The present invention concerns placement of the grippable device on a player's limb such that it is relatively tightly held in a fixed position about the limb. In the preferred embodiment the fixing means is facilitated in its ability to resist movement on the skin surface once the grippable device is in position about a given limb.

Preferred embodiments of the present invention are used as lifting aids in a variety of activities including sports games such as a game of rugby. In the best mode contemplated by the inventor the grippable sports device is configured to aid a rugby player to be lifted by a plurality of supporting players. By lifting aid it is meant herein a device for placement upon a limb of the body of a person such that the person may be more readily lifted and lifted to a greater height by one or more further people than would be the case without use of grippable sports devices configured in accordance with the present invention. Embodiments of the present invention comprise a main body such that the main body, when in use on a person's limb, is in the form of a band. By the term "band" it is meant herein a structure that substantially encircles a limb upon which it is to be affixed and which is not part of a larger garment of clothing and in particular which does not form a part of a pair of shorts. The band may be considered to constitute a hollow tubular structure (or a sleeve) that is substantially cylindrical or frusto-conical in shape when the device is in use on, for example, the thigh of a rugby player. In contrast to use of gripping structures located on a pair of shorts use of a band structure provides many advantages such as versatility as regards its use by players having different body sizes and in particular different circumferences of their limbs. Furthermore the sports bands configured in accordance with the present invention may be readily removed and replaced during a game as desired whereas this is clearly not possible with shorts that comprise grippable devices. In one preferred embodiment of a grippable sports device configured in accordance with the present invention a sports band is configured as a unitary member, that is a one piece member.

Bands as configured in accordance with preferred embodiments of the present invention may comprise a single piece of material in the form of a sleeve that is made of a suitably elastic material. A good example would be silicone rubber since this is inherently elastic and it provides a first (internal) non-slip surface for interfacing with the limb of the person wearing the device and a second (external) non-slip surface by which a second person may attempt to grip the device. The devices may be substantially solid walled throughout or they may be configured in other forms with various regions of the wall regions cut-away such as is the case of the example of FIG. 2 wherein the two elastic or elasticized portions 204 and 205 are all that traverses the rear side of a limb.

The grippable sports device as illustrated in FIG. 2 comprises a main region 203 for gripping by another person than the person wearing the device and it furthermore comprises elastic or elasticized regions 204 and 205, respectively located at each end of the band. The example of FIG. 2 concerns use of an upper and a lower elastic or elasticized portion for securing the device to a leg or other limb of a person. However rather than having end elastic or elasticized portions a grippable sports device as configured in accordance with the present invention may comprise elastic substantially along all the length and/or circumference of the device. In other words the entire band may be formed of an elastic or elasticized material such that the band substantially comprises a cylindrical shape that is substantially symmetrical about the main longitudinal axis passing through the substantially circular ends of the band. In FIG. 2 the longitudinal axis through the band would pass vertically through the centre of the circle formed by elastic or elasticized portion 204 down to and through the centre of the circle formed by elastic or elasticized portion 205. In other words the walls of the cylinder of FIG. 2 are cut-away (on the back wall away from portion 203) whereas in another preferred embodiment no such cut-away portion is provided, instead the wall 202 extending right the way around the circumference of the band. In this latter embodiment it is preferred that wall 202 is itself made of an elastic or elasticized material, thereby rendering the need for specially configured end elastic or elasticized portions 204, 205 as potentially unnecessary.

In the best mode contemplated the grippable sports device as configured in accordance with the present invention is configured with at least a portion that is elastic or elasticized such that it may be tightly fitted around a given limb of a person wearing the device. By elastic in respect of a body or material, it is herein meant that the body or material is capable of returning to its original shape after compression, expansion, stretching or other deformation. In this way the body or material is allowed to stretch when being placed in position upon a given person and to contract or return to substantially its original shape when it is being removed from a given person that was wearing the device. Thus when a given person is wearing a grippable sports device configured in accordance with the present invention, the device automatically and substantially resumes to its original shape or size when a distorting force (caused by a player's limb located within the device) is removed. The degree of elasticity of the body or material of the grippable sports device of the present invention is somewhat arbitrary, but in the best mode it should be such that when the device is affixed to a given person's limb the device does not readily change its position about the limb during use.

In the best mode contemplated a grippable sports device as configured in accordance with the present invention comprises a band having fixing means for fixing the band to a limb. The fixing means itself comprises a band for substantially encircling a portion of the limb and the fixing means band comprises an elastic or elasticized material for effecting the fixing of the band to the limb. The fixing is provided by virtue of the elastic tension provided by the elastic material when the fixing means is in position on a limb. The fixing means may itself comprise a band of elastic material that substantially or entirely encircles the limb. Alternatively the fixing band may be formed by a substantially circular shaped region that, for a part of its circumference is not made of an elastic and for another part of its circumference is made of a suitably elastic material. In either of these latter two cases the elastic tension required to firmly hold the device to a limb can be adequately provided. When the device is not in use, that is it is at rest, the fixing means (or the elastic or elasticized portion thereof) assumes a first state as regards its shape and when the device is in use about the limb of a person the elastic or elasticized fixing means (or elastic or elasticized portion thereof) assumes a second shape by virtue of the elastic or elasticized material having been stretched.

In a preferred embodiment of the present invention, the band structure may be fixed by an elastic or elasticized portion or by virtue of the entire body being made of a suitably elastic or elasticized material. In yet a further preferred embodiment, in addition to being held in place by virtue of the elastic tension provided by the band material (or a part of the band material) the band may be also held in place by an additional fixing means such as a substantially non-elastic or non-elasticized strap or an elastic or elasticized strap used to tighten the device about a limb by means of the well-known loop and pile (e.g. Velcro®) type fixing.

The grippable surfaces schematically illustrated in the earlier Figures are merely provided as examples. By grippable it is meant a surface that is non-slip and, in the best mode, this is provided by virtue of the material itself and/or the use of at least one integral raised member protruding from the main outer surface level of the device. High friction type materials provide a high degree of grip between the hands and the device and between the limb and the device. However as indicated previously the grip may be further enhanced in a variety of other ways. As already indicated a protruding ridge member may be provided in a grippable sports device as configured in accordance with a preferred mode of implementing the present invention. By a protruding ridge member it is meant a ridge that is configured to abut against the fingers of a person gripping the device. As shown in FIG. 3 the ridge member is perpendicular to the longitudinal axis that passes through the circular ends of the device. Thus when a lifting device as configured in accordance with the invention is placed upon a limb the protruding ridge is transverse to the longitudinal axis of the main bone that is associated with a limb to which the device is attached. In the best mode as regards orientation of the ridge and as is schematically illustrated in FIG. 3, the protruding ridge is perpendicular to the longitudinal axis of the main bone that is associated with a limb to which the device is attached.

Figure 5A:
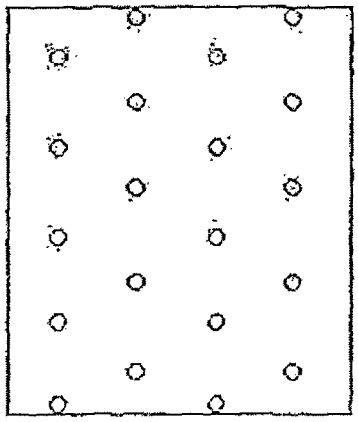
FIGS. 5*a* and 5*b* schematically further schematically illustrates a first preferred embodiment of an enhanced grippable surface of a grippable sports device as configured in accordance with the present invention.
Figure 5B:
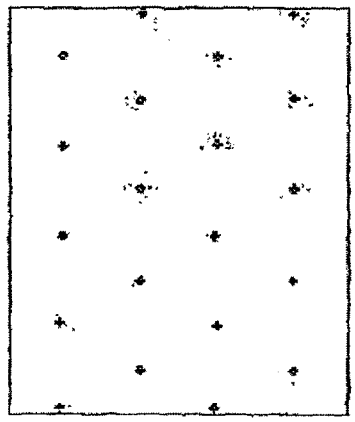

The grippable surface of FIG. 3 comprises a series of points and this is further schematically illustrated in FIGS. 5*a* and 5*b*. FIG. 5*a* schematically illustrates an enhanced gripping structure that comprises a series of raised points of the main gripping surface. FIG. 5*a* is a three-dimensional (perspective) view and FIG. 5*b* illustrates the same arrangement in two-dimensional (plan) view. The enhanced grip comprises a series of protruding points in the form of protruding half-spheres. The half-spheres protrude from the main grippable surface and thereby provide regions against which the fingers of a person attempting to grip the device may press against, the direction of the force applied by the fingers thereby being enhanced in the direction defined from the bottom of the device to a point vertically above at the top of the device. In the two-dimensional (plan) view of FIG. 5*b* the protrusions are shown as points and in the perspective view of FIG. 5*a* they are shown as to comprise a hemispherical (half-sphere) shape. However those skilled in the art will realize that it is the fact that the protrusions extend away from the main gripping surface which provides the enhanced grip. Therefore other shapes may readily be contemplated besides hemispherical type protrusions. A further example would be parallelepiped shaped protrusions arranged as an array of points in a similar array-configuration as that shown.

Figure 6A:
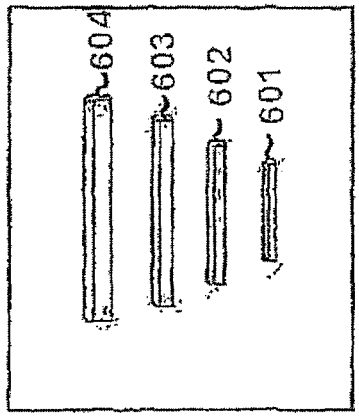
FIGS. 6*a* and 6*b* schematically illustrates a second preferred embodiment of an enhanced grippable surface of a grippable sports device as configured in accordance with the present invention, the surface comprising a series of stepped ridges.
Figure 6B:
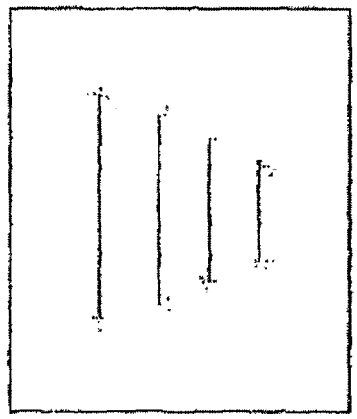

FIGS. 6*a* and 6*b* show an alternative enhanced grip surface of a grippable sport device as configured in accordance with the present invention. The system schematically illustrated in FIGS. 6*a* and 6*b* concerns a stepped pyramid pattern such that a series of horizontal abutment members are provided with increasing height. The first abutment member 601 is of lowest height. Further along the grippable surface there is provided a second abutment member 602 having a slightly greater height. Member 602 is followed by a further abutment member 603 that has a slightly greater height than member 602 and in turn there is provided a fourth member 604 which has the greatest height. All abutment members 601 to 604 are configured to be transverse to a main longitudinal axis passing through the substantially circular ends of a given band. Members 601 to 604 may be of equal lengths, but in the preferred embodiment they are stepped to form the inverted pyramid pattern that is schematically illustrated.

Figure 7A:
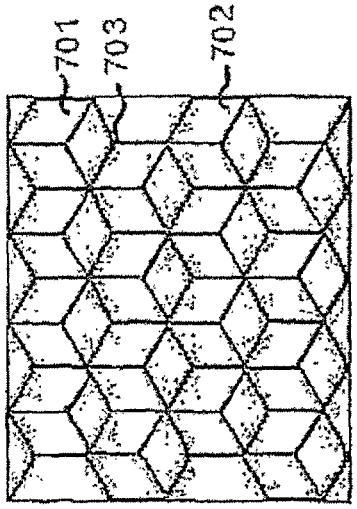
FIGS. 7*a* and 7*b* schematically illustrates a third preferred embodiment of an enhanced grippable surface of a grippable sports device as configured in accordance with the present invention, the surface comprising a honeycomb structure.
Figure 7B:
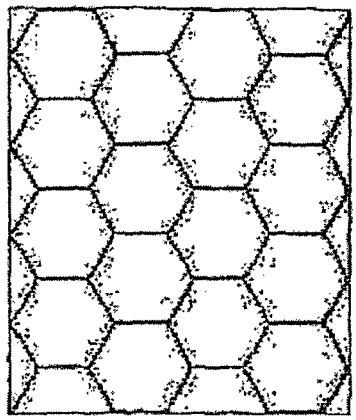

As a further example of an enhanced gripping arrangement for a grippable sports device as configured in accordance with the present invention, there is schematically illustrated in FIGS. 7*a* and 7*b* a hexagonal honeycomb pattern. In this arrangement the surface of a given grippable sports device is arranged such that in plan view it comprises a plurality of interlocking orifices, each orifice being in the shape of a hexagon. FIG. 7*b* schematically illustrates the array of interlocking hexagonally shaped orifices. FIG. 7*a* further details this arrangement which may be considered to be comprised in-part by a plurality of cuboids that have been removed from the surface leaving their imprint. In this way a plurality of orifices 701 and 702 are formed with a protruding generally cuboid structure being located between neighboring orifices. Thus for example point 703 constitutes the outer point of a protruding generally cuboid structure which is in contrast to the neighboring regions above (701) and below (702) which respectively constitute orifices. The combination of orifice type structures and protruding generally cuboid type structures provides a non-even surface which thereby provides a non-slip surface for a person to grip rather than a mere smooth surface.

In all of the preferred embodiments of enhanced grip, the enhancement is provided by means of at least one protruding member being provided to protrude, that is extend away from, the surrounding surface of the grippable device. In this way surfaces are produced by the exemplary types of protrusion mentioned above for a person's hands to press against.

In contrast to the prior art usage of tape the preferred embodiments of the present invention are advantageous in that they are re-usable. The devices configured in accordance with preferred embodiments of the present invention may be re-used a large number of times and they may be configured to fit a wide variety of sizes of limb. In the best mode they are configured as unitary bands comprising a single piece of material or a plurality of pieces of material that are preferably permanently fixed to one another. Although it is possible to make a grippable sports device in accordance with the present invention out of a single material, the skilled person in the art will readily understand that either one material or a plurality of materials may be used.

In the preferred embodiment the present invention comprises at least one raised member that is raised from the remainder of the grippable surface. The raised member may be sewn, stitched, glued, molded or fixed by other means to form a unitary device as regards the at least one raised member and the main body of the device.

By the term "limb" the normal everyday meaning is to be understood and therefore the term limb is considered to include the arms and legs of a person.

Although the first aspect of the present invention concerns use of elasticity to secure a band to a limb a further aspect concerns sports bands which are not to be considered as limited to any form of elasticity as regards their being fixed to a limb. This further aspect concerns the use of at least one integral raised member to enhance the grippable surface of a sports band as previously described and as set out in various of the claims appended hereto.

The invention claimed is:

1. A sports lifting aid, comprising:

a main body configured to be positioned on the thigh of a sports player for use during a sports game, said main body comprising fixing means that substantially encircles a portion of said thigh to thereby fix said main body in a substantially fixed position directly on said thigh of said player and said main body further comprising grip means to enable a second player of said sports game to grip said main body and thereby lift said first player, wherein:

said lifting aid is in the form of a sports band not constituting a part of a pair of shorts, said grip means comprises a non-slip grip surface specifically configured to enable said second player of said sports game to grip said main body and at least a portion of said fixing means substantially comprises an elastic or elasticized material for effecting said fixing by virtue of the elastic tension provided by said elastic material.

2. A lifting aid as claimed in claim 1, wherein when said lifting aid is in use said lifting aid is configured to remain in a substantially fixed position on a portion of the thigh of said first player.

3. A lifting aid as claimed in claim 1 wherein said non-slip grip surface comprises a ridge that provides an abutting surface.

4. A lifting aid as claimed in claim 1 wherein said non-slip grip surface comprises a ridge wherein said ridge is formed as an integral part of said main body.

5. A lifting aid as claimed in claim 1 wherein said non-slip grip surface comprises a ridge arranged to extend in a direction that is substantially perpendicular to the main longitudinal axis passing through open ends of said band.

6. A lifting aid as claimed in claim 1 wherein said non-slip grip surface comprises a plurality of protruding members wherein said plurality of protruding members comprises a plurality of different shapes.

7. A lifting aid as claimed in claim 1, wherein said non-slip grip surface comprises a plurality of protruding members in the form of an array of raised points.

8. A lifting aid as claimed in claim 1 wherein said non-slip grip surface comprises a plurality of protruding members in the form of an array of ridges.

9. A lifting aid as claimed in claim 1 wherein said non-slip grip surface comprises a plurality of protruding members in the form of an array of raised members interspersed with orifices, said raised members and orifices collectively forming a honeycomb structure.

10. A lifting aid as claimed in claim 1, wherein said fixing means comprises silicone rubber.

11. A lifting aid as claimed in claim 1, wherein said fixing means comprises an elastic portion and a non-elastic portion.

12. A lifting aid as claimed in claim 1, wherein said fixing means does not include use of an adhesive.

13. A lifting aid as claimed in claim 1, wherein said lifting aid does not comprise an adhesive tape.

14. A lifting aid as claimed in claim 1, wherein said band comprises a substantially fully walled sleeve.

15. A lifting aid as claimed in claim 1, wherein said band comprises a non-fully walled sleeve.

16. A lifting aid as claimed in claim 1, wherein in addition to said fixing means said lifting aid further comprises an additional fixing means in the form of a strap.

17. A lifting aid as claimed in claim 1, wherein said fixing means further comprises a second fixing means in the form of a strap, said second fixing means comprising a loop and pile fixing arrangement.

18. A lifting aid as claimed in claim 1, wherein said grip surface comprises at least one protruding member in the form of a ridge for further aiding said second player to raise said first player off of the ground, said ridge configured to abut against at least a first hand of said second player to thereby prevent said hand slipping beyond said ridge.

* * * * *